US007439923B2

(12) United States Patent
Quintero Illera et al.

(10) Patent No.: US 7,439,923 B2
(45) Date of Patent: Oct. 21, 2008

(54) MULTIBAND ANTENNA

(75) Inventors: Ramiro Quintero Illera, Barcelona (ES); Carles Puente Ballarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 11/702,791

(22) Filed: Feb. 6, 2007

(65) Prior Publication Data

US 2007/0132658 A1 Jun. 14, 2007

Related U.S. Application Data

(63) Continuation of application No. 10/823,257, filed on Apr. 13, 2004, now Pat. No. 7,215,287, which is a continuation of application No. PCT/EP01/011912, filed on Oct. 16, 2001.

(51) Int. Cl.
*H01Q 1/24* (2006.01)

(52) U.S. Cl. ..... 343/702; 343/700 MS; 343/895

(58) Field of Classification Search ..... 343/700 MS, 343/702, 829, 846, 800, 895
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,024,542 | A | 5/1977 | Ikawa et al. |
| 4,131,893 | A | 12/1978 | Munson et al. |
| 4,141,016 | A | 2/1979 | Nelson |
| 4,471,358 | A | 9/1984 | Glasser |
| 4,471,493 | A | 9/1984 | Schober |
| 4,504,834 | A | 3/1985 | Garay et al. |

(Continued)

FOREIGN PATENT DOCUMENTS

CA 2416437 A1 1/2002

(Continued)

OTHER PUBLICATIONS

Jani Ollikaninen et al., "Internal Dual-Band Patch Antenna for Mobile Phones", European Space Agency, Millennium Conference on Antennas & Propagation, Apr. 9-14, 2000.

(Continued)

*Primary Examiner*—Tho G Phan
(74) *Attorney, Agent, or Firm*—Winstead PC

(57) ABSTRACT

The present invention relates generally to a new family of antennas with a multiband behavior, so that the frequency bands of the antenna can be tuned simultaneously to the main existing wireless services. In particular, the invention consists of shaping at least one of the gaps between some of the polygons of the multilevel structure in the form of a non-straight curve, shaped in such a way that the whole gap length is increased yet keeping its size and the same overall antenna size. Such a configuration allows an effective tuning of the frequency bands of the antenna, such that with the same overall antenna size, said antenna can be effectively tuned simultaneously to some specific services, such as for instance the five frequency bands that cover the services AMPS, GSM900, GSM1800, PCS1900, UMTS, Bluetooth™, IEEE802.11b, or HyperLAN.

50 Claims, 7 Drawing Sheets

U.S. PATENT DOCUMENTS 4,543,581 A 9/1985 Nemet
4,571,595 A 2/1986 Phillips et al.
4,584,709 A 4/1986 Kneisel et al.
4,590,614 A 5/1986 Erat
4,623,894 A 11/1986 Lee et al.
4,673,948 A 6/1987 Kuo
4,730,195 A 3/1988 Phillips et al.
4,839,660 A 6/1989 Hadzoglou
4,843,468 A 6/1989 Drewery
4,847,629 A 7/1989 Shimazaki
4,849,766 A 7/1989 Inaba et al.
4,857,939 A 8/1989 Shimazaki
4,890,114 A 12/1989 Egashira
4,894,663 A 1/1990 Urbish et al.
4,907,011 A 3/1990 Kuo
4,912,481 A 3/1990 Mace et al.
4,975,711 A 12/1990 Lee
5,030,963 A 7/1991 Tadama
5,138,328 A 8/1992 Zibrik et al.
5,168,472 A 12/1992 Lockwood
5,172,084 A 12/1992 Fiedziuszko et al.
5,200,756 A 4/1993 Feller
5,214,434 A 5/1993 Hsu
5,218,370 A 6/1993 Blaese
5,227,804 A 7/1993 Oda
5,227,808 A 7/1993 Davis
5,245,350 A 9/1993 Sroka
5,248,988 A 9/1993 Makino
5,255,002 A 10/1993 Day
5,257,032 A 10/1993 Diamond et al.
5,347,291 A 9/1994 Moore
5,355,144 A 10/1994 Walton et al.
5,355,318 A 10/1994 Dionnet et al.
5,373,300 A 12/1994 Jenness et al.
5,402,134 A 3/1995 Miller et al.
5,420,599 A 5/1995 Erkocevic
5,422,651 A 6/1995 Chang
5,451,965 A 9/1995 Matsumoto
5,451,968 A 9/1995 Emery
5,453,751 A 9/1995 Tsukamoto et al.
5,457,469 A 10/1995 Diamond et al.
5,471,224 A 11/1995 Barkeshli
5,493,702 A 2/1996 Crowley et al.
5,495,261 A 2/1996 Baker et al.
5,534,877 A 7/1996 Sorbello et al.
5,537,367 A 7/1996 Lockwood et al.
5,684,672 A 11/1997 Karidis et al.
5,712,640 A 1/1998 Andou et al.
5,767,811 A 6/1998 Mandai et al.
5,798,688 A 8/1998 Schofield
5,821,907 A 10/1998 Zhu et al.
5,841,403 A 11/1998 West
5,867,126 A 2/1999 Kawahata et al.
5,870,066 A 2/1999 Asakura et al.
5,872,546 A 2/1999 Ihara et al.
5,898,404 A 4/1999 Jou
5,903,240 A 5/1999 Kawahata et al.
5,926,141 A 7/1999 Lindenmeier et al.
5,943,020 A 8/1999 Liebendoerfer et al.
5,966,097 A 10/1999 Fukasawa et al.
5,966,098 A 10/1999 Qi et al.
5,973,651 A 10/1999 Suesada et al.
5,986,610 A 11/1999 Miron
5,990,838 A 11/1999 Burns et al.
6,002,367 A 12/1999 Engblom et al.
6,028,568 A 2/2000 Asakura et al.
6,031,499 A 2/2000 Dichter
6,031,505 A 2/2000 Qi et al.
6,078,294 A 6/2000 Mitarai
6,091,365 A 7/2000 Derneryd et al.
6,097,345 A 8/2000 Walton
6,104,349 A 8/2000 Cohen
6,127,977 A 10/2000 Cohen
6,131,042 A 10/2000 Lee et al.
6,140,969 A 10/2000 Lindenmeier et al.
6,140,975 A 10/2000 Cohen
6,160,513 A 12/2000 Davidson et al.
6,172,618 B1 1/2001 Hakozaki et al.
6,211,824 B1 4/2001 Holden et al.
6,218,992 B1 4/2001 Sadler et al.
6,236,372 B1 5/2001 Lindenmeier et al.
6,252,554 B1 6/2001 Isohatala et al.
6,266,023 B1 7/2001 Nagy et al.
6,281,846 B1 8/2001 Puente Baliarda et al.
6,307,511 B1 10/2001 Ying et al.
6,329,951 B1 12/2001 Wen et al.
6,329,954 B1 12/2001 Fuchs et al.
6,343,208 B1 * 1/2002 Ying ..... 455/575.7
6,366,243 B1 * 4/2002 Isohatala et al. ..... 343/700 MS
6,367,939 B1 4/2002 Carter et al.
6,407,710 B2 6/2002 Keilen et al.
6,417,810 B1 7/2002 Huels et al.
6,431,712 B1 8/2002 Turnbull
6,445,352 B1 9/2002 Cohen
6,452,549 B1 9/2002 Lo
6,452,551 B1 9/2002 Chen et al.
6,452,553 B1 9/2002 Cohen
6,466,176 B1 10/2002 Maoz
6,476,766 B1 11/2002 Cohen
6,476,767 B2 11/2002 Aoyama et al.
6,496,148 B2 12/2002 Kouam
6,525,691 B2 2/2003 Varadan et al.
6,545,640 B1 4/2003 Herve et al.
6,552,690 B2 4/2003 Veerasamy
6,606,062 B2 8/2003 Kouam et al.
6,642,898 B2 11/2003 Eason
6,664,932 B2 12/2003 Sabet et al.
2002/0000940 A1 1/2002 Moren et al.
2002/0000942 A1 1/2002 Duroux
2002/0003499 A1 1/2002 Kouam et al.
2002/0036594 A1 3/2002 Gyenes
2002/0105468 A1 8/2002 Tessier et al.
2002/0109633 A1 8/2002 Ow et al.
2002/0126054 A1 9/2002 Fuerst et al.
2002/0126055 A1 9/2002 Lindenmeier et al.
2002/0175866 A1 11/2002 Gram
2002/0175879 A1 11/2002 Sabet et al.
2002/0196191 A1 12/2002 Kouam
2004/0217916 A1 11/2004 Illera et al.

FOREIGN PATENT DOCUMENTS

DE 3337941 5/1985
EP 0096847 12/1983
EP 0297813 6/1988
EP 0358090 8/1989
EP 0543645 5/1993
EP 0571124 11/1993
EP 0688040 12/1995
EP 0765001 3/1997
EP 0814536 12/1997
EP 0871238 10/1998
EP 0892459 1/1999
EP 0929121 7/1999
EP 0932219 7/1999
EP 0969375 1/2000
EP 0986130 3/2000
EP 0942488 4/2000
EP 0997974 5/2000
EP 1018777 7/2000
EP 1018779 7/2000
EP 1071161 1/2001
EP 10794462 2/2001
EP 1083624 3/2001

| | | |
|---|---|---|
| EP | 1094545 | 4/2001 |
| EP | 1096602 | 5/2001 |
| EP | 1128466 | 8/2001 |
| EP | 1148581 | 10/2001 |
| EP | 1198027 | 4/2002 |
| EP | 1237224 | 9/2002 |
| EP | 1267438 | 12/2002 |
| ES | 2112163 | 3/1998 |
| ES | 2142280 | 5/1998 |
| FR | 2543744 | 10/1984 |
| FR | 2704359 | 10/1994 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |
| JP | 5129816 | 5/1993 |
| JP | 5267916 | 10/1993 |
| JP | 5347507 | 12/1993 |
| JP | 6204908 | 7/1994 |
| JP | 10209744 | 8/1998 |
| WO | 9511530 | 4/1995 |
| WO | 9627219 | 9/1996 |
| WO | 9629755 | 9/1996 |
| WO | 9638881 | 12/1996 |
| WO | 9706578 | 2/1997 |
| WO | 9711507 | 3/1997 |
| WO | 9732355 | 9/1997 |
| WO | 9733338 | 9/1997 |
| WO | 9735360 | 9/1997 |
| WO | 9747054 | 12/1997 |
| WO | 9812771 | 3/1998 |
| WO | 9836469 | 8/1998 |
| WO | 9903166 | 1/1999 |
| WO | 9903167 | 1/1999 |
| WO | 9925042 | 5/1999 |
| WO | 9927608 | 6/1999 |
| WO | 9956345 | 11/1999 |
| WO | 0001028 | 1/2000 |
| WO | 0003453 | 1/2000 |
| WO | 0022695 | 4/2000 |
| WO | 0036700 | 6/2000 |
| WO | 0049680 | 8/2000 |
| WO | 0052784 | 9/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0122528 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0148861 | 7/2001 |
| WO | 0154225 | 7/2001 |
| WO | 0173890 | 10/2001 |
| WO | 0178192 | 10/2001 |
| WO | 0182410 | 11/2001 |
| WO | 0235646 | 5/2002 |
| WO | 02091518 | 11/2002 |
| WO | 02096166 | 11/2002 |
| WO | WO-02/095874 | 11/2002 |
| WO | WO-03/023900 | 3/2003 |

OTHER PUBLICATIONS

"Small Circulatory Polarized Microstrip Antennas" Wen-Shyang Chen, Department of Electronic Engineering, Cheng-Shiu Institute of Technology, 1999 IEEE.

Ali, M. et al., "A Triple-Band Internal Antenna for Mobile Hand-held Terminals," IEEE, pp. 32-35 (1992).

Romeu, Jordi et al., "A Three Dimensional Hilbert Antenna," IEEE, pp. 550-553 (2002).

Parker et al., "Microwaves, Antennas & Propagation," IEEE Proceedings H, pp. 19-22 (Feb. 1991).

Hansen, R.C., "Fundamental Limitations in Antennas," Proceedings of the IEEE, vol. 69, No. 2, pp. 170-182 (Feb. 1981).

Jaggard, Dwight L., "Fractal Electrodynamics and Modeling," Directions in Electromagnetic Wave Modeling, pp. 435-466 (1991).

Hohifeld, Robert G. et al., "Self-Similarity and the Geometric Requirements for Frequency Independance in Antennac," Fractals, vol. 7, No. 1, pp. 79-84 (1999).

Samavati, Hirad, et al., "Fractal Capacitors," IEEE Journal of Solid-State Circuits, vol. 33, No. 12, pp. 2035-2041 (Dec. 1998).

Pribetich, P., et al., "Quasifractal Planar Microstrip Resonators for Microwave Circuits," Microwave and Optical Technology Letters, vol. 21, No. 6, pp. 433-436 (Jun. 20, 1999).

Zhang, Dawei, et al., "Narrowband Lumped-Element Microstrip Filters Using Capacitively-Loaded Inductors," IEEE MTT-S Microwave Symposium Digest, pp. 379-382 (May 16, 1995).

Gough, C.E., et al., "High Tc coplanar resonators for microwave applications and scientific studies," Physica C, NL,North-Holland Publishing, Amsterdam, vol. 282-287, No. 2001. pp. 395-398 (Aug. 1, 1997).

Radio Engineering Reference—Book by H. Meinke and F.V. Gundlah, vol. 1, Radio components. Circuits with lumped parameters. Transmission lines. Wave-guides. Resonators. Arrays. Radio waves propagation, States Energy Publishing House, Moscow, with English translation (1961) [4pp.].

V.A. Volgov, "Parts and Units of Radio Electronic Equipment (Design & Computation)," Energiya, Moscow, with English translation (1967) [4 pp.].

Puente, C., et al., "Multiband properties of a fractal tree antenna generated by electrochemical deposition," Electronics Letters, IEE Stevenage, GB, vol. 32, No. 25, pp. 2298-2299 (Dec. 5, 1996).

Puente, C., et al., "Small but long Koch fractal monopole," Electronics Letters, IEE Stevenage, GB, vol. 34, No. 1, pp. 9-10 (Jan. 8, 1998).

Puente Baliarda, Carles, et al., "The Koch Monopole: A Small Fractal Antenna," IEEE Transactions on Antennas and Propagation, New York, US, vol. 48, No. 11, pp. 1773-1781 (Nov. 1, 2000).

Cohen, Nathan, "Fractal Antenna Applications in Wireless Telecommunications," Electronics Industries Forum of New England, 1997, Professional Program Proceedings Boston, MA US, May 6-8, 1997, New York, NY US, IEEE, US pp. 43-49 (May 6, 1997).

Anguera, J. et al. "Miniature Wideband Stacked Microstrip Patch Antenna Based on the Sicrpinski Fractal Geometry," IEEE Antennas and Propagation Society International Symposium, 2000 Digest. Aps., vol. 3 of 4, pp. 1700-1703 (Jul. 16, 2000).

Hara Prasad, R.V., et al., "Microstrip Fractal Patch Antenna for Multi-Band Communication," Electronics Letters, IEE Stevenage, GB, vol. 36, No. 14, pp. 1179-1180 (Jul. 6, 2000).

Borja, C. et al., "High Directive fractal Boundary Microstrip Patch Antenna," Electronics Letters, IEE Stevenage, GB, vol. 36, No. 9. pp. 778-779 (Apr. 27, 2000).

Sanad, Mohamed, "A Compact Dual-Broadband Microstrip Antenna Having Both Stacked and Planar Parasitic Elements," IEEE Antennas and Propagation Society International Symposium 1996 Digest, Jul. 21-26, 1996, pp. 6-9.

Morishita, H. et al, Design concept of antennas for small mobile terminals and the future perspective, IEEE Antennas and propagation magazine, Oct. 2002.

Chen, H. et al, Duel-frequency rectangular microstrip antenna with double pi-shaped slots, Microwave and optical technology letters, May 5, 2001.

Lu, J., Single-feed dual-frequency triangular microstrip antenna with a pair of bent slots, Microwave and optical technology letters, Mar. 20, 2001.
Chen, H.; Lin, Y., Bandwidth enhancement of a microstrip antenna with embedded reactive loading, Microwave and optical technology letters, Jul. 20, 2000.
Mumbru, J. et al, Analysis and improvements of the J. Ollikainen, O. Kivekäs, A. Toropainen, P. Vainikainen, "Internal Dual-Band Patch Antenna for Mobile Phones, APS-2000 Millennium Conference on Antennas and Propagation", Davos, Switzerland, Apr. 2000, Fractus, dated Jul. 4, 2001, revised Dec. 9, 2005.
Kim, H. et al, Surface-mounted chip dielectric ceramic antenna for PCS phone, 5th International Symposium on Antennas, Propagation and EM Theory, 2000. Proceedings. ISAPE 2000, Aug. 15, 2000.

* cited by examiner

MULTIBAND ANTENNA

This patent application is a continuation of U.S. patent application Ser. No. 10/823,257, filed on Apr. 13, 2004 now U.S. Pat. No. 7,215,287, U.S. patent application Ser. No. 10/823,257 is a continuation of PCT/EP01/011912, filed on Oct. 16, 2001. U.S. patent application Ser. No. 10/823,257 and International Application No. PCT/EP01/011912 are incorporated herein by reference.

OBJECT AND BACKGROUND OF THE INVENTION

The present invention relates generally to a new family of antennas with a multiband behaviour. The general configuration of the antenna consists of a multilevel structure which provides the multiband behaviour. A description on Multilevel Antennas can be found in Patent Publication No. WO01/22528. In the present invention, a modification of said multilevel structure is introduced such that the frequency bands of the antenna can be tuned simultaneously to the main existing wireless services. In particular, the modification consists of shaping at least one of the gaps between some of the polygons in the form of a non-straight curve.

Several configurations for the shape of said non-straight curve are allowed within the scope of the present invention. Meander lines, random curves or space-filling curves, to name some particular cases, provide effective means for conforming the antenna behaviour. A thorough description of Space-Filling curves and antennas is disclosed in patent "Space-Filling Miniature Antennas" (Patent Publication No. WO01/54225).

Although patent publications WO01/22528 and WO01/54225 disclose some general configurations for multiband and miniature antennas, an improvement in terms of size, bandwidth and efficiency is obtained in some applications when said multilevel antennas are set according to the present invention. Such an improvement is achieved mainly due to the combination of the multilevel structure in conjunction of the shaping of the gap between at least a couple of polygons on the multilevel structure. In some embodiments, the antenna is loaded with some capacitive elements to finely tune the antenna frequency response.

In some particular embodiments of the present invention, the antenna is tuned to operate simultaneously at five bands, those bands being for instance GSM900 (or AMPS), GSM1800, PCS1900, UMTS, and the 2.4 GHz band for services such as for instance Bluetooth™, IEEE802.11b and HiperLAN. There is in the prior art one example of a multilevel antenna which covers four of said services, see embodiment (3) in FIG. 1, but there is not an example of a design which is able to integrate all five bands corresponding to those services aforementioned into a single antenna.

The combination of said services into a single antenna device provides an advantage in terms of flexibility and functionality of current and future wireless devices. The resulting antenna covers the major current and future wireless services, opening this way a wide range of possibilities in the design of universal, multi-purpose, wireless terminals and devices that can transparently switch or simultaneously operate within all said services.

SUMMARY OF THE INVENTION

The key point of the present invention consists of combining a multilevel structure for a multiband antenna together with an especial design on the shape of the gap or spacing between two polygons of said multilevel structure. A multilevel structure for an antenna device consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles and ellipses are included as well, since they can be understood as polygons with a very large (ideally infinite) number of sides. Some particular examples of prior-art multilevel structures for antennas are found in FIG. 1. A thorough description on the shapes and features of multilevel antennas is disclosed in patent publication WO01/22528. For the particular case of multilevel structure described in drawing (3), FIG. 1 and in FIG. 2, an analysis and description on the antenna behaviour is found in (J. Ollikainen, O. Kivekäs, A. Toropainen, P. Vainikainen, "Internal Dual-Band Patch Antenna for Mobile Phones", APS-2000 Millennium Conference on Antennas and Propagation, Davos, Switzerland, April 2000).

When the multiband behaviour of a multilevel structure is to be packed in a small antenna device, the spacing between the polygons of said multilevel structure is minimized. Drawings (3) and (4) in FIG. 1 are some examples of multilevel structures where the spacing between conducting polygons (rectangles and squares in these particular cases) take the form of straight, narrow gaps. In the present invention, at least one of said gaps is shaped in such a way that the whole gap length is increased yet keeping its size and the same overall antenna size. Such a configuration allows an effective tuning of the frequency bands of the antenna, such that with the same overall antenna size, said antenna can be effectively tuned simultaneously to some specific services, such as for instance the five frequency bands that cover the services AMPS, GSM900, GSM1800, PCS1900, UMTS, Bluetooth™, IEEE802.11b or HyperLAN.

FIGS. 3 to 7 show some examples of how the gap of the antenna can be effectively shaped according to the present invention. For instance, gaps (109), (110), (112), (113), (114), (116), (118), (120), (130), (131), and (132) are examples of non-straight gaps that take the form of a curved or branched line. All of them have in common that the resonant length of the multilevel structure is changed, changing this way the frequency behaviour of the antenna. Multiple configurations can be chosen for shaping the gap according to the present invention:

a) A meandering curve.
b) A periodic curve.
c) A branching curve, with a main longer curve with one or more added segments or branching curves departing from a point of said main longer curve.
d) An arbitrary curve with 2 to 9 segments.
e) An space-filling curve.

An Space-Filling Curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the gap according to the present invention, the segments of the SFC curves included in said multilevel structure must be shorter than a tenth of the free-space operating wavelength.

It is interesting noticing that, even though ideal fractal curves are mathematical abstractions and cannot be physically implemented into a real device, some particular cases of SFC can be used to approach fractal shapes and curves, and therefore can be used as well according to the scope and spirit of the present invention.

The advantages of the antenna design disclosed in the present invention are:

(a) The antenna size is reduced with respect to: other prior-art multilevel antennas.

(b) The frequency response of the antenna can be tuned to five frequency bands that cover the main current and future wireless services (among AMPS, GSM900, GSM1800, PCS1900, Bluetooth™, IEEE802.11b and HipeLAN).

Those skilled in the art will notice that current invention can be applied or combined to many existing prior-art antenna techniques. The new geometry can be, for instance, applied to microstrip patch antennas, to Planar Inverted-F antennas (PIFAs), to monopole antennas and so on. FIGS. 6 and 7 describe some patch of PIFA like configurations. It is also clear that the same antenna geometry can be combined with several ground-planes and radomes to find applications in different environments: handsets, cellular phones and general hand-held devices; portable computers (Palmtops, PDA, Laptops, . . . ), indoor antennas (WLAN, cellular indoor coverage), outdoor antennas for microcells in cellular environments, antennas for cars integrated in rear-view mirrors, stop-lights, bumpers and so on.

In particular, the present invention can be combined with the new generation of ground-planes described in the PCT application entitled "Multilevel and Space-Filling Ground-planes for Miniature and Multiband Antennas", which describes a ground-plane for an antenna device, comprising at least two conducting surfaces, said conducting surfaces being connected by at least a conducting strip, said strip being narrower than the width of any of said two conducting surfaces.

When combined to said ground-planes, the combined advantages of both inventions are obtained: a compact-size antenna device with an enhanced bandwidth, frequency behaviour, VSWR, and efficiency.

DETAILED DESCRIPTION OF THE PREFERRED EMBODIMENTS

Figure 1:
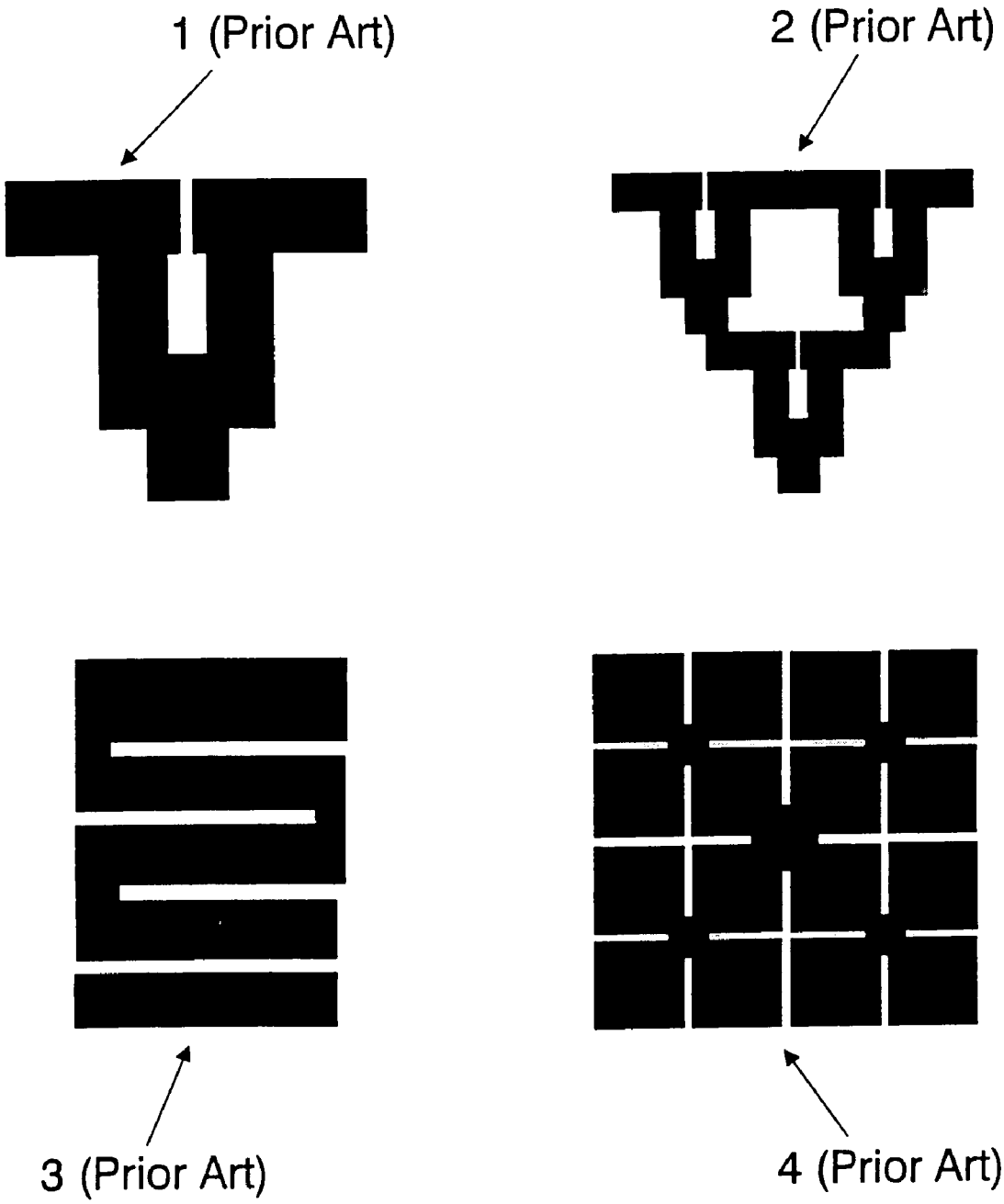
FIG. 1 describes four particular examples (1), (2), (3), (4) of prior-art multilevel geometries for multilevel antennas.
Figure 2:
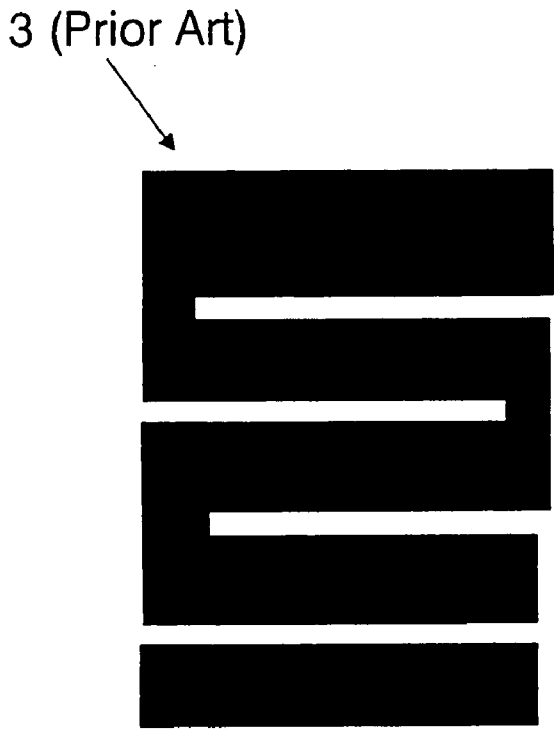
FIG. 2 describes a particular case of a prior-art multilevel antenna formed with eight rectangles (101), (102), (103), (104), (105), (106), (107), and (108).
Figure 2:
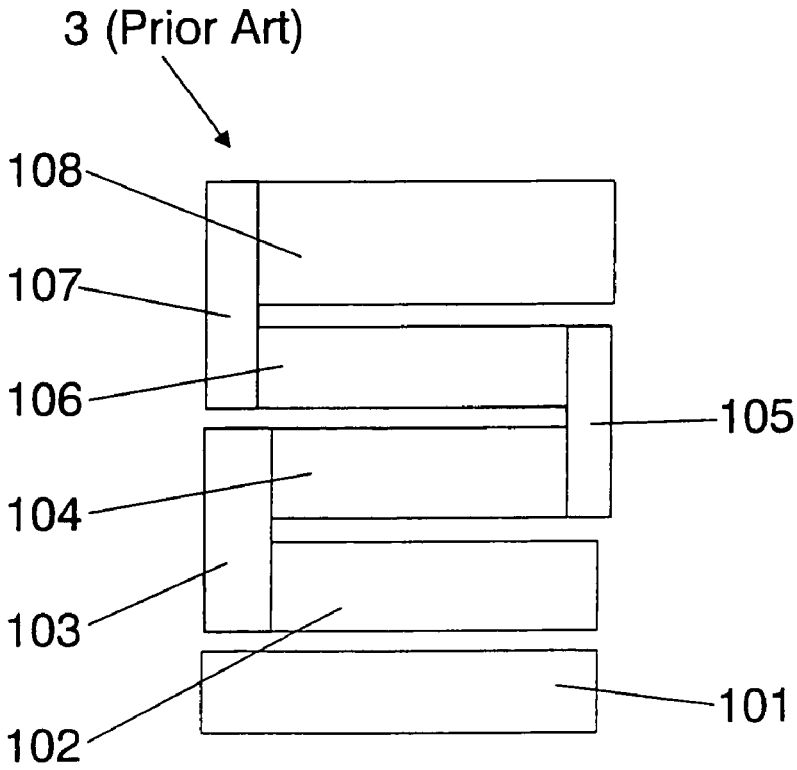
Figure 3:
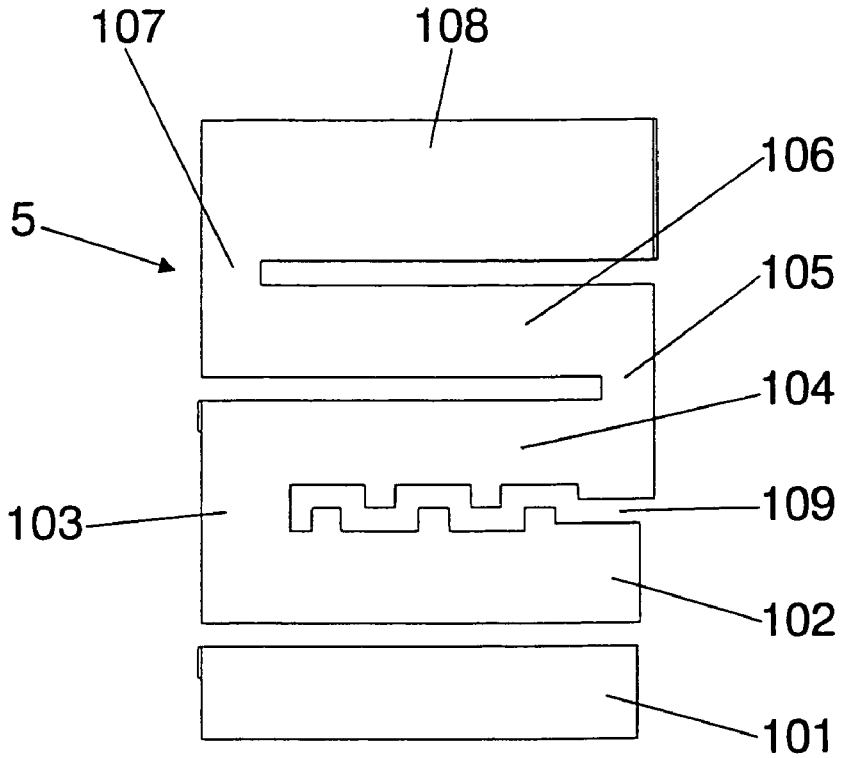
FIG. 3 drawings (5) and (6) show two embodiments of the present invention. Gaps (109) and (110) between rectangles (102) and (104) of design (3) are shaped as non-straight curves (109) according to the present invention.
Figure 3:
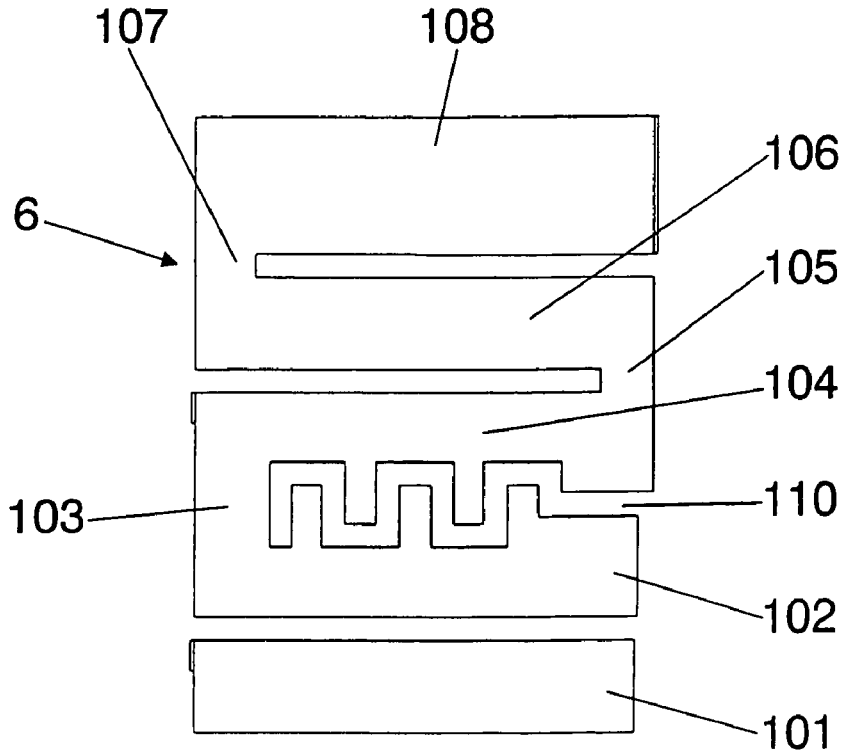

Drawings (5) and (6) in FIG. 3 show two particular embodiments of the multilevel structure and the non-linear gap according to the present invention. The multilevel structure is based on design (3) in FIG. 2 and it includes eight conducting rectangles: a first rectangle (101) being capacitively coupled to a second rectangle (102), said second rectangle being connected at one tip to a first tip of a third rectangle (103), said third rectangle being substantially orthogonal to said second rectangle, said third rectangle being connected at a second tip to a first tip of a fourth rectangle (104), said fourth rectangle being substantially orthogonal to said third rectangle and substantially parallel to said second rectangle, said fourth rectangle being connected at a second tip to a first tip of a fifth rectangle (105), said fifth rectangle being substantially orthogonal to said fourth rectangle and substantially parallel to said third rectangle, said fifth rectangle being connected at a second tip to a first tip of a sixth rectangle (106), said sixth rectangle being substantially orthogonal to said fifth rectangle and substantially parallel to said fourth rectangle, said sixth rectangle being connected at a second tip to a first tip of a seventh rectangle (107), said seventh rectangle being substantially orthogonal to said sixth rectangle and parallel to said fifth rectangle, said seventh rectangle being connected to a first tip of an eighth rectangle (108), said eighth rectangle being substantially orthogonal to said seventh rectangle and substantially parallel to said sixth rectangle.

Both designs (5) and (6) include a non-straight gap (109) and (110) respectively, between second (102) and fourth (104) polygons. It is clear that the shape of the gap and its physical length can be changed. This allows a fine tuning of the antenna to the desired frequency bands in case the conducting multilevel structure is supported by a high permittivity substrate.

The advantage of designs (5) and (6) with respect to prior art is that they cover five bands that include the major existing wireless and cellular systems (among AMPS, GSM900, GSM1800, PCS1900, UMTS, Bluetooth™, IEEE802.11b, HiperLAN).

Figure 4:
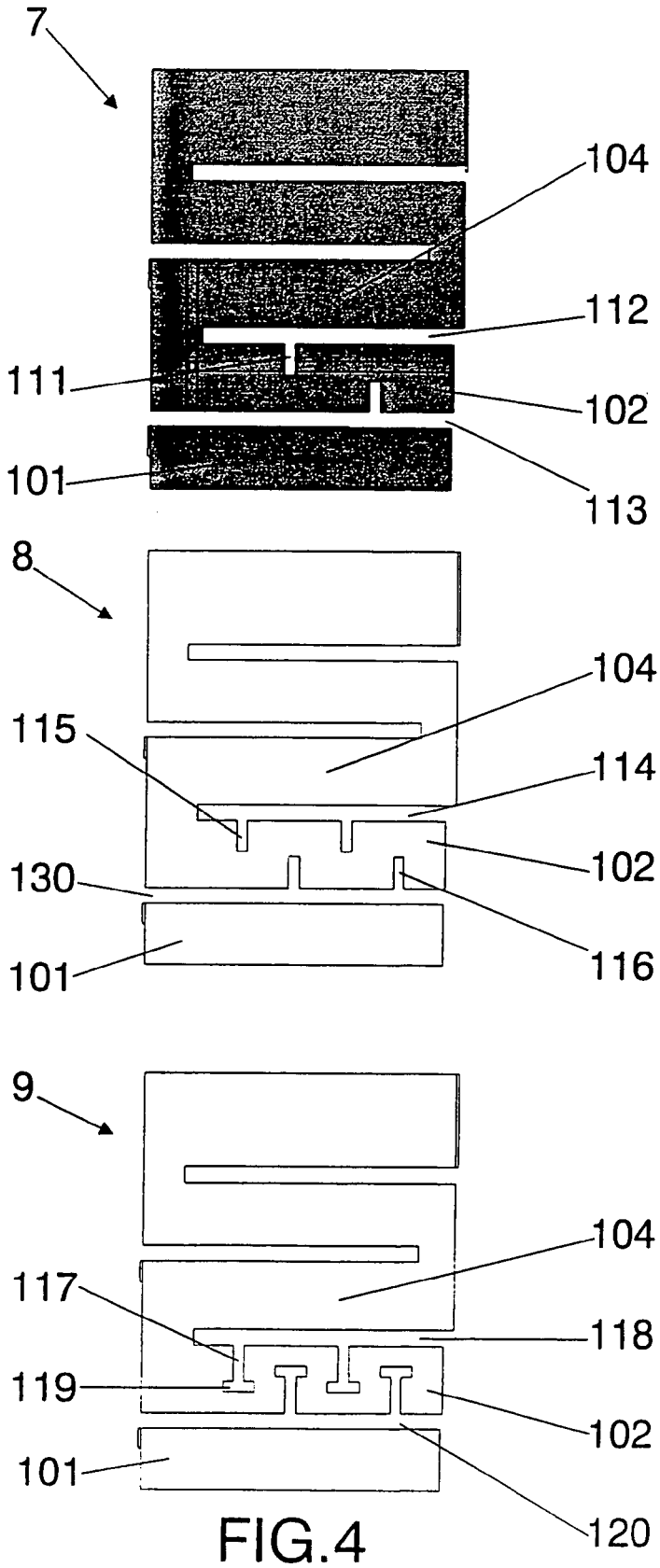
FIG. 4 shows three examples of embodiments (7), (8), (9) for the present invention. All three have in common that include branching gaps (112), (113), (114), (130), (118), (120).

Three other embodiments for the invention are shown in FIG. 4. All three are based on design (3) but they include two shaped gaps. These two gaps are placed between rectangle (101) and rectangle (102), and between rectangle (102) and (104) respectively. In these examples, the gaps take the form of a branching structure. In embodiment (7) gaps (112) and (113) include a main gap segment plus a minor gap-segment (111) connected to a point of said main gap segment.

In embodiment (8), gaps (114) and (116) include respectively two minor gap-segments such as (115). Many other branching structures can be chosen for said gaps according to the present invention, and for instance more convoluted shapes for the minor gaps as for instance (117) and (119) included in gaps (118) and (120) in embodiment (9) are possible within the scope and spirit of the present invention.

Figure 5:
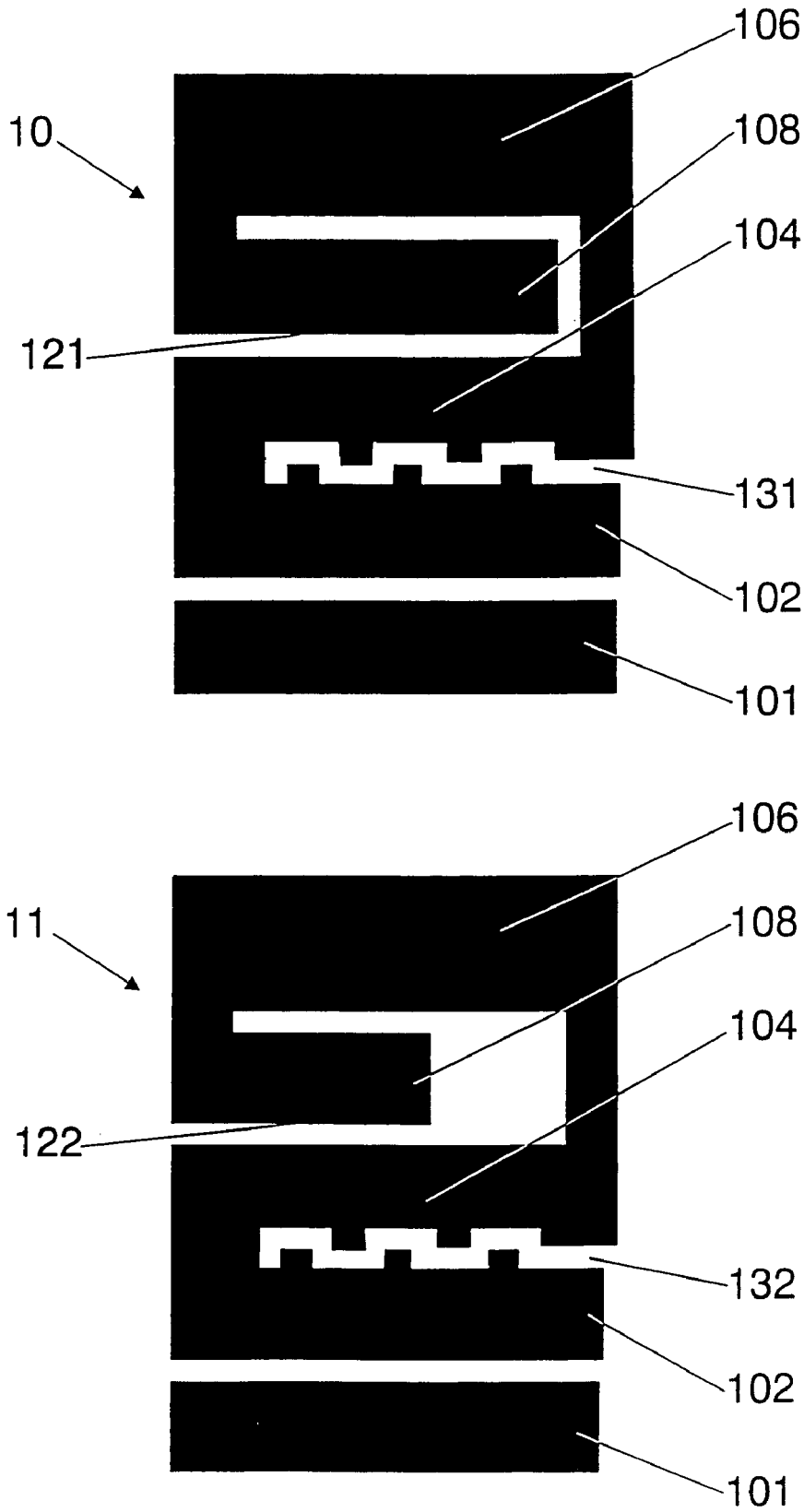
FIG. 5 shows two particular embodiments (10) and (11) for the present invention. The multilevel structure consists of a set of eight rectangles as in the case of design (3), but rectangle (108) is placed between rectangle (104) and (106). Non-straight, shaped gaps (131) and (132) are placed between polygons (102) and (104).

Although design in FIG. 3 has been taken as an example for embodiments in FIGS. 3 and 4, other eight-rectangle multilevel structures, or even other multilevel structures with a different number of polygons can be used according to the present invention, as long as at least one of the gaps between two polygons is shaped as a non-straight curve. Another example of an eight-rectangle multilevel structure is shown in embodiments (10) and (11) in FIG. 5. In this case, rectangle (108) is placed between rectangles (106) and (104) respectively. This contributes in reducing the overall antenna size with respect to design (3). Length of rectangle (108) can be adjusted to finely tune the frequency response of the antenna (different lengths are shown as an example in designs (10) and (11)) which is useful when adjusting the position of some of the frequency bands for future wireless services, or for instance to compensate the effective dielectric permittivity when the structure is built upon a dielectric surface.

Figure 6:
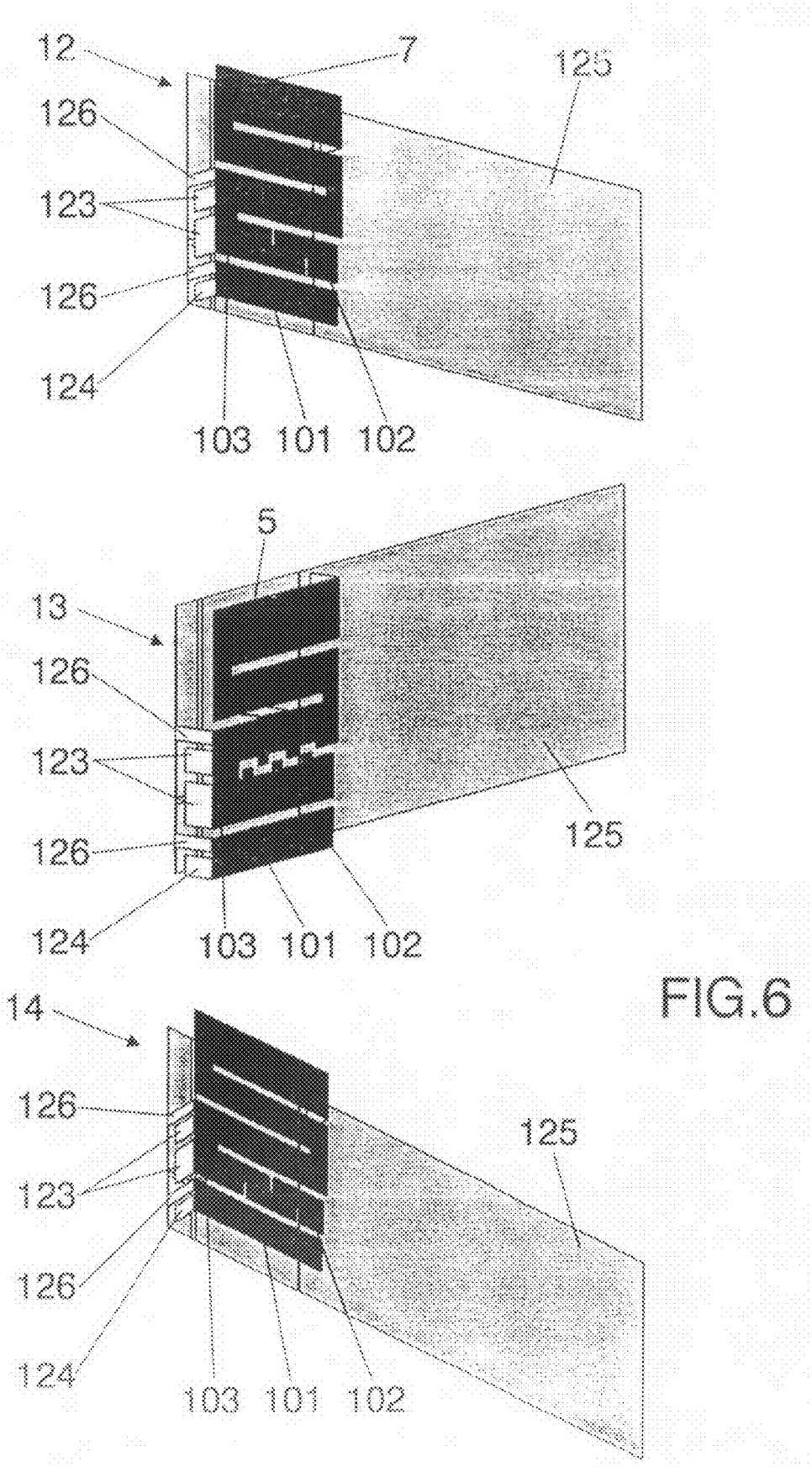
FIG. 6 shows three particular embodiments (12), (13), (14) for three complete antenna devices based on the combined multilevel and gap-shaped structure disclosed in the present invention. All three are mounted in a rectangular ground-plane such that the whole antenna device can be, for instance, integrated in a handheld or cellular phone. All three include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103).

FIG. 6 shows three examples of embodiments (12), (13), and (14) where the multilevel structure is mounted in a particular configuration as a patch antenna. Designs (5) and (7) are chosen as a particular example, but it is obvious that any other multilevel structure can be used in the same manner as well, as for instance in the case of embodiment (14). For the embodiments in FIG. 6, a rectangular ground-plane (125) is included and the antenna is placed at one end of said ground-plane. These embodiments are suitable, for instance, for handheld devices and cellular phones, where additional space is required for batteries and circuitry. The skilled in the art will notice, however, that other ground-plane geometries and positions for the multilevel structure could be chosen, depending on the application (handsets, cellular phones and general handheld devices; portable computers such as Palmtops, PDA, Laptops, indoor antennas for WLAN, cellular indoor coverage, outdoor antennas for microcells in cellular environments, antennas for cars integrated in rear-view mirrors, stop-lights, and bumpers are some examples of possible applications) according to the present invention.

All three embodiments (12), (13), (14) include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103). Additionally, a loading capacitor at the end of rectangle (108) can be used for the tuning of the antenna.

It will be clear to those skilled in the art that the present invention can be combined in a novel way to other prior-art antenna configurations. For instance, the new generation of ground-planes disclosed in the PCT application entitled "Multilevel and Space-Filling Ground-planes for Miniature and Multiband Antennas" can be used in combination with the present invention to further enhance the antenna device in terms of size, VSWR, bandwidth, and/or efficiency. A particular case of ground-plane (125) formed with two conducting surfaces (127) and (129), said surfaces being connected by means of a conducting strip (128), is shown as an example in embodiment (15).

Figure 7:
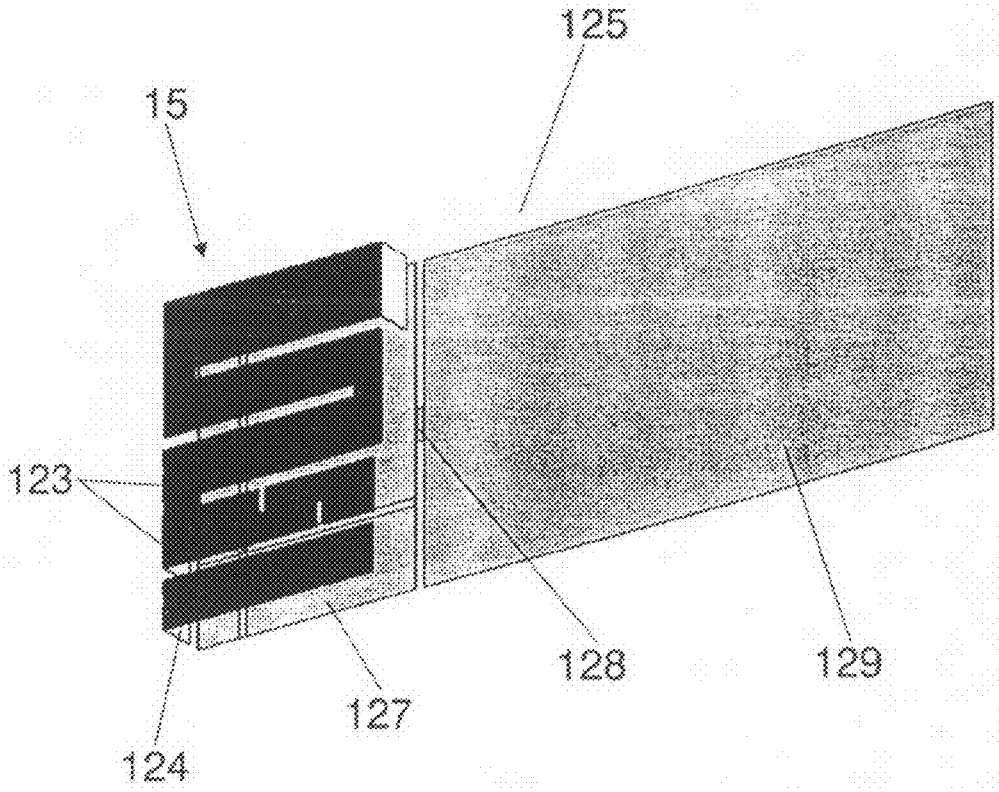
FIG. 7 shows a particular embodiment (15) of the invention combined with a particular case of Multilevel and Space-Filling ground-plane according to the PCT application entitled "Multilevel and Space-Filling Ground-planes for Miniature and Multiband Antennas". In this particular case, ground-plane (125) is formed by two conducting surfaces (127) and (129) with a conducting strip (128) between said two conducting surfaces.

The particular embodiments shown in FIGS. 6 and 7 are similar to PIFA configurations in the sense that they include a shorting-plate or pin for a patch antenna upon a parallel ground-plane. The skilled in the art will notice that the same multilevel structure including the non-straight gap can be used in the radiating elements of other possible configurations, such as for instance, monopoles, dipoles or slotted structures.

It is important to stress that the key aspect of the invention is the geometry disclosed in the present invention. The manufacturing process or material for the antenna device is not a relevant part of the invention and any process or material described in the prior-art can be used within the scope and spirit of the present invention. To name some possible examples, but not limited to them, the antenna could be stamped in a metal foil or laminate; even the whole antenna structure including the multilevel structure, loading elements and ground-plane could be stamped, etched or laser cut in a single metallic surface and folded over the short-circuits to obtain, for instance, the configurations in FIGS. 6 and 7. Also, for instance, the multilevel structure might be printed over a dielectric material (for instance FR4, Rogers®, Arlon® or Cuclad®) using conventional printing circuit techniques, or could even be deposited over a dielectric support using a two-shot injecting process to shape both the dielectric support and the conducting multilevel structure.

The invention claimed is;

1. A multiband antenna comprising:

a multilevel conducting structure, substantial portions of which are formed of a plurality of first generally identifiable polygons;

said plurality of polygons including geometric elements identifiably defined by a free perimeter thereof and a projection of the longest exposed perimeter thereof to define the least number of generally identifiable polygons within a region;

at least two polygons of said plurality of polygons being interconnected by a conducting strip which is narrower in width than either one of the at least two polygons; and wherein the at least two polygons of said plurality of polygons are separated by a non-straight gap contributing to tuning a frequency behavior of the multiband antenna.

2. The multiband antenna of claim 1, wherein the plurality of polygons are selected from the group consisting of:

triangles;

quadrilaterals;

pentagons;

hexagons;

octagons;

circles; and ellipses.

3. The multiband antenna of claim 1, wherein the non-straight gap comprises at least one of:

a meandering curve;

a periodic curve;

a branching curve comprising a main longer curve and at least one added segment or branching curves departing from a point of said main longer curve;

an arbitrary curve comprising 2-9 segments; and a space-filling curve.

4. The multiband antenna of claim 1, wherein the non-straight gap comprises a plurality of second polygons, the plurality of second polygons being substantially smaller than the plurality of first generally identifiable polygons.

5. The multiband antenna of claim 1, further comprising at least one capacitive element that loads the multiband antenna.

6. The multiband antenna of claim 1, wherein the multiband antenna is tuned to operate simultaneously in the following frequency bands: GSM900; GSM1800; PCS1900; UMTS; and 2.4 GHz.

7. The multiband antenna of claim 1, wherein select ones of adjacent polygons are coupled by ohmic contact through the conducting strip.

8. The multiband antenna of claim 1, wherein the non-straight gap tunes the multiband antenna to a predetermined plurality of frequency bands.

9. The multiband antenna of claim 1, wherein the non-straight gap serves to modify a resonating frequency of a plurality of resonating frequencies of the multiband antenna relative to a multiband antenna comprising an otherwise identical gap without the non-straight gap.

10. The multiband antenna of claim 9, wherein the non-straight gap affects only the modified resonating frequency and not other resonating frequencies of the plurality of resonating frequencies.

11. The multiband antenna of claim 1, comprising a ground plane.

12. The multiband antenna of claim 11, comprising a loading element.

13. The multiband antenna of claim 1, wherein the length of the sides defined between connected polygons is less than 50% of the perimeter of the polygons in at least 75% of the polygons defining the multilevel conducting structure.

14. A multiband antenna comprising:

at least one multilevel conducting structure, substantial portions of which are formed of a set of first generally identifiable polygons having an equal number of sides or faces;

said set of polygons including geometric elements identifiably defined by a free perimeter thereof and a projection of the longest exposed perimeter thereof to define the least number of generally identifiable polygons within a region;

at least two polygons of said set of polygons being coupled by a conducting strip which is narrower in width than either one of the at least two polygons; and wherein the at least two polygons of said set of polygons are separated by a non-straight gap contributing to tuning a frequency behavior of the multiband antenna.

15. The multiband antenna of claim 14, wherein the plurality of polygons are selected from the group consisting of:

triangles;

quadrilaterals;

pentagons;

hexagons;

octagons;

circles; and ellipses.

16. The multiband antenna of claim 14, wherein the non-straight gap comprises at least one of:

a meandering curve;

a periodic curve;

a branching curve comprising a main longer curve and at least one added segment or branching curves departing from a point of said main longer curve;

an arbitrary curve comprising 2-9 segments; and a space-filling curve.

17. The multiband antenna of claim 14, wherein the non-straight gap comprises a plurality of second polygons, the plurality of second polygons being substantially smaller than the plurality of first generally identifiable polygons.

18. The multiband antenna of claim 14, further comprising at least one capacitive element that loads the multiband antenna.

19. The multiband antenna of claim 14, wherein the multiband antenna is tuned to operate simultaneously in the following frequency bands: GSM900; GSM1800; PCS1900; UMTS; and 2.4 GHz.

20. The multiband antenna of claim 14, wherein select ones of adjacent polygons are coupled by ohmic contact through the conducting strip.

21. The multiband antenna of claim 14, wherein the non-straight gap tunes the multiband antenna to a predetermined plurality of frequency bands.

22. The multiband antenna of claim 14, wherein the non-straight gap serves to modify a resonating frequency of a plurality of resonating frequencies of the multiband antenna relative to a multiband antenna comprising an otherwise identical gap without the non-straight gap.

23. The multiband antenna of claim 22, wherein the non-straight gap affects only the modified resonating frequency and not other resonating frequencies of the plurality of resonating frequencies.

24. The multiband antenna of claim 14, comprising a ground plane.

25. The multiband antenna of claim 24, comprising a loading element.

26. A multiband antenna having a multilevel conducting structure constructed with a plurality of polygons having multiple exposed and connected sides, with the connected sides forming contact regions between at least two generally identifiable polygons, the multilevel conducting structure comprising:

at least two polygons electromagnetically coupled one to the other through one or both of exposed and connected sides, with each of the at least two polygons having the same number of sides;

sides of the polygons along a contact region being defined by the projection of the longest exposed side extending into the contact region of connected polygons; and the at least two polygons being separated by a non-straight gap contributing to tuning a frequency behavior of the multiband antenna.

27. The multiband antenna of claim 26, wherein the plurality of polygons are selected from the group consisting of:

triangles;

quadrilaterals;

pentagons;

hexagons;

octagons;

circles; and ellipses.

28. The multiband antenna of claim 26, wherein the non-straight gap comprises at least one of:

a meandering curve;

a periodic curve;

a branching curve comprising a main longer curve and at least one added segment or branching curves departing from a point of said main longer curve;

an arbitrary curve comprising 2-9 segments; and a space-filling curve.

29. The multiband antenna of claim 26, further comprising at least one capacitive element that loads the multiband antenna.

30. The multiband antenna of claim 26, wherein the multiband antenna is tuned to operate simultaneously in the following frequency bands: GSM900; GSM1800; PCS1900; UMTS; and 2.4 GHz.

31. The multiband antenna of claim 26, wherein a first polygon and a second polygon are electromagnetically coupled by ohmic contact.

32. The multiband antenna of claim 26, wherein the non-straight gap tunes the multiband antenna to a predetermined plurality of frequency bands.

33. The multiband antenna of claim 26, comprising a third polygon having the same number of sides as a first polygon and a second polygon and electromagnetically coupled to at least one of the first polygon and the second polygon.

34. The multiband antenna of claim 26, wherein the non-straight gap serves to modify a resonating frequency of a plurality of resonating frequencies of the multiband antenna relative to a multiband antenna comprising an otherwise identical gap without the non-straight gap.

35. The multiband antenna of claim 34, wherein the non-straight gap affects only the modified resonating frequency and not other resonating frequencies of the plurality of resonating frequencies.

36. The multiband antenna of claim 26, comprising a ground plane.

37. The multiband antenna of claim 36, comprising a loading element.

38. The multiband antenna of claim 26, wherein the length of the sides defined between connected polygons is less than 50% of the perimeter of the polygons in at least 75% of the polygons defining the multilevel conducting structure.

39. An antenna-tuning method comprising:

designing a multiband antenna having a multilevel conducting structure constructed with a plurality of generally identifiable polygons having multiple exposed and connected sides;

forming, via the connected sides, a contact region between at least two polygons;

electromagnetically coupling, via one or both of exposed and connected sides, the at least two polygons, each of the at least two polygons having the same number of sides;

tuning a frequency behavior of the multiband antenna, the tuning step comprising shaping a gap between the at least two polygons in the form of a non-straight curve without altering the overall size of the multiband antenna; and wherein the shaping step comprises modifying a resonating frequency of a plurality of resonating frequencies of the multiband antenna relative to a multiband antenna comprising an otherwise identical gap without the non-straight curve.

40. The antenna-tuning method of claim 39, wherein the non-straight curve comprises at least one of:

a meandering curve;

a periodic curve;

a branching curve comprising a main longer curve and at least one added segment or branching curves departing from a point of said main longer curve;

an arbitrary curve comprising 2-9 segments; and a space-filling curve.

41. The antenna-tuning method of claim 39, further comprising loading the multiband antenna with at least one capacitive element.

42. The antenna-tuning method of claim 39, wherein the multiband antenna is tuned to operate simultaneously in the following frequency bands: GSM900; GSM1800; PCS1900; UMTS; and 2.4 GHz.

43. The antenna-tuning method of claim 39, wherein the plurality of polygons are selected from the group consisting of:

triangles;

quadrilaterals;

pentagons;

hexagons;

octagons;

circles; and ellipses.

44. The antenna-tuning method of claim 39, wherein a first polygon and a second polygon are electromagnetically coupled by ohmic contact.

45. The antenna-tuning method of claim 39, wherein the shaped gap tunes the multiband antenna to a predetermined plurality of frequency bands.

46. The antenna-tuning method of claim 39, wherein the non-straight curve affects only the modified resonating frequency and not other resonating frequencies of the plurality of resonating frequencies.

47. The antenna-tuning method of claim 39, wherein sides of the plurality of polygons along the contact region are defined by the projection of the longest exposed side extending from the contact region of connected polygons.

48. The antenna-tuning method of claim 39, wherein the length of the sides defined between connected polygons is less than 50% of the perimeter of the polygons in at least 75% of the polygons defining the multilevel conducting structure.

49. A multiband antenna comprising:

at least one multilevel conducting structure, substantial portions of which include at least one antenna region comprising a plurality of first generally identifiable polygons;

said plurality of polygons including geometric elements identifiably defined by a free perimeter thereof and a projection of the longest exposed perimeter thereof to define the least number of generally identifiable polygons within a region;

at least two polygons of said plurality of polygons being interconnected by a conducting strip which is narrower in width than either one of the at least two polygons; and wherein the at least two polygons of said plurality of polygons are separated by a non-straight gap contributing to tuning a frequency behavior of the multiband antenna.

50. An antenna-tuning method comprising:

designing a multiband antenna having a multilevel conducting structure;

forming substantial portions of the multilevel conducting structure with a plurality of first generally identifiable polygons, said plurality of polygons including geometric elements identifiably defined by a free perimeter thereof and a projection of the longest exposed perimeter thereof to define the least number of generally identifiable polygons within a region;

interconnecting at least two polygons of said plurality of polygons with a conducting strip which is narrower in width than either one of the at least two polygons; and tuning a frequency behavior of the multiband antenna through shaping of a gap between the at least two polygons of said plurality of polygons in the form of a non-straight curve without altering the overall size of the multiband antenna.

* * * * *